United States Patent [19]

Wüthrich

[11] Patent Number: 4,684,771

[45] Date of Patent: Aug. 4, 1987

[54] VACUUM SWITCH

[75] Inventor: Hans-Rudolf Wüthrich, Oberentfelden, Switzerland

[73] Assignee: Sprecher & Schuh AG, Aarau, Switzerland

[21] Appl. No.: 733,654

[22] Filed: May 13, 1985

[30] Foreign Application Priority Data

May 18, 1984 [CH] Switzerland ..... 2443/84

[51] Int. Cl.[4] ..... H01H 33/66

[52] U.S. Cl. ..... 200/144 B; 200/255

[58] Field of Search ..... 200/144 B, 255, 256, 200/260, 261; 339/253 R, 253 L, 254 R, 263 L, 255 P, 273 F, 273 S

[56] References Cited

U.S. PATENT DOCUMENTS

| | | | |
|---|---|---|---|
| 1,752,236 | 3/1930 | Conklin | 200/255 |
| 3,739,120 | 6/1973 | Starr | 200/144 B |
| 4,408,110 | 10/1983 | Ladet et al. | 200/268 |

FOREIGN PATENT DOCUMENTS

| | | | |
|---|---|---|---|
| 1070260 | 12/1959 | Fed. Rep. of Germany . | |
| 551687 | 7/1974 | Switzerland . | |
| 913466 | 3/1982 | U.S.S.R. | 200/255 |

*Primary Examiner*—Charles Frankfort
*Assistant Examiner*—W. Morris Worth
*Attorney, Agent, or Firm*—Werner W. Kleeman

[57] ABSTRACT

An axially reciprocatable actuation rod is conducted out of a vacuum chamber and connected with one of the terminals of a vacuum switch by a connecting conductor. In order to exploit the short switching stroke which is characteristic of vacuum switches and thereby reduce the construction expenditure for the connecting conductor, the connecting conductor is constructed as a yoke whose ends are forked. These opposed ends of the connecting conductor engage at one end thereof the actuation rod and at the other end thereof a protrusion on the terminal extending in the direction of the actuation rod. The opposed ends frictionally engage the actuation rod and the protrusion elastically at mutually opposing locations thereof.

11 Claims, 6 Drawing Figures

Fig. 1
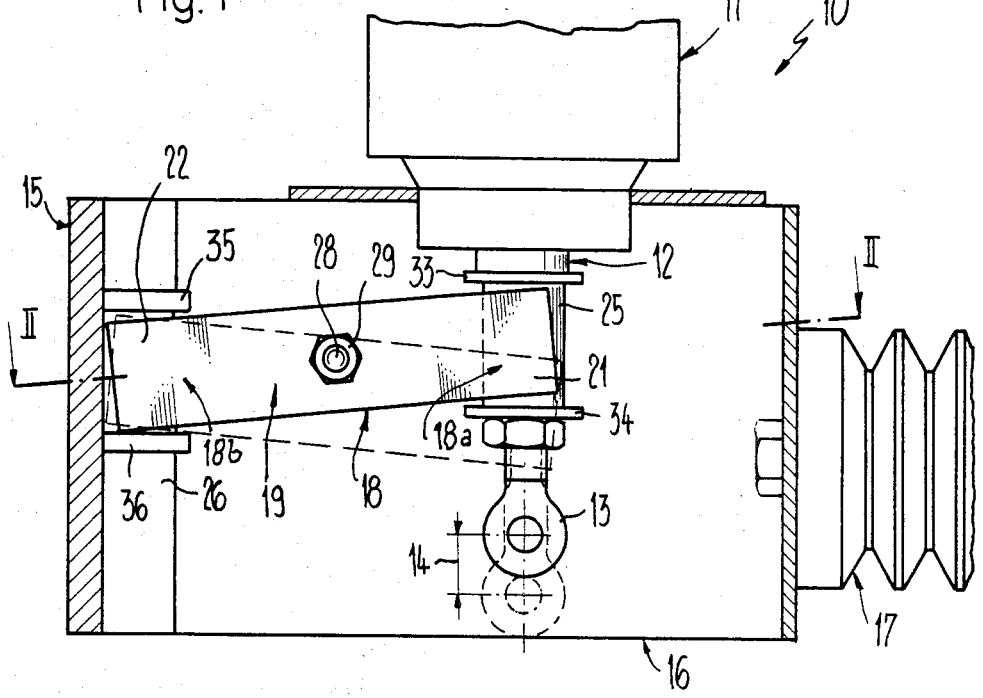
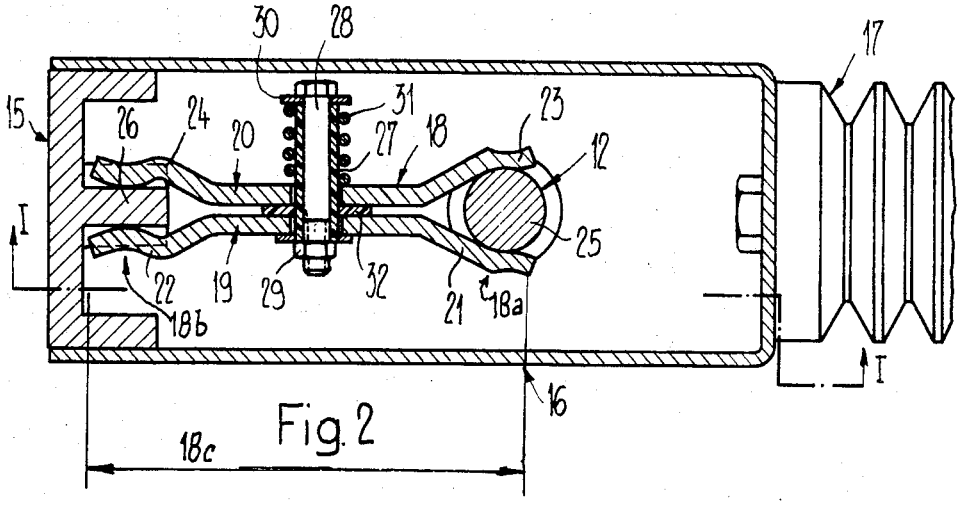
Fig. 2

VACUUM SWITCH

BACKGROUND OF THE INVENTION

The present invention broadly relates to vacuum switches and, more specifically, pertains to a new and improved construction of a vacuum switch having an actuation rod electrically connected to a terminal of the switch.

Generally speaking, the vacuum switch of the present invention comprises a vacuum chamber, a contact actuation rod sealingly conducted out of the vacuum chamber and reciprocatable through a predetermined length of stroke, and electrical terminals which are to be commutated by the vacuum switch. The contact actuation rod is electrically connected to the terminal by a connecting conductor.

One characteristic which distinguishes vacuum switches from switches of other construction for comparable voltages, for instance low oil content switches or gas-blast switches, is the relatively small switching stroke executed by the movable contact member. Among other things, this permits a very compact construction. The actuation rod conducted out of the vacuum chamber and electrically connected with the movable contact member must, however, be connected with one of the stationary terminals of the switch by a connecting conductor, as must other types of switches as well.

In known vacuum switches of the initially mentioned type, for instance as disclosed in the Swiss Patent No. 551,687, and Swiss Patent No. 585,959, the connecting conductor consists of a copper cable or a flexible conductor strap which is usually provided at both ends with soldered terminal connectors which, in turn, are fixedly clamped to the terminal member, on the one hand, and to the actuation rod, on the other hand, by means of threaded connectors. This connecting conductor requires considerable effort to produce and assemble and is, when conducting heavy currents, subject to magnetic forces emanating from such currents, with the result that the position and shape of this connecting conductor can vary within the switch from switch stroke to switch stroke, since the copper cable is very flexible.

Other vacuum switches have adopted constructions for this connecting conductor which are common in switches having considerably greater switch strokes. For instance, the vacuum switches described in the Swiss Patent No. 558,078 comprise encircling slide contacts between the actuation rods leading into the vacuum chamber and the associated terminals. When using such slide contacts, the frictional resistance to be overcome by the switch drive must be very considerable in order to guarantee good contact.

In order to reduce this frictional resistance, the actuation rod in the vacuum switch according to the U.S. Pat. No. 3,997,741, granted Dec. 14, 1976, is surrounded by an irregular, preferably corrugated, sleeve made from a good conducting material and whose inner side contacts the outer side of the actuation rod along one or more of its generatrices. This sleeve, in turn, is surrounded by a stationary tube arranged coaxially with the actuation rod and which is fixedly connected with the terminal. Compressible bars or rods, for instance made of rubber, are inserted between the inner side of the tube and the outer side of the irregular sleeve which tend to hold the irregular sleeve in a deformed configuration and therefore in contact with both the tube and the actuation rod. This construction may well guarantee good contact between the actuation rod and the switch terminal with a low frictional resistance, but it involves a very great constructional expense and is not able to derive any advantage from the short switch strokes characteristic of vacuum switches.

Analogous remarks with respect to constructional effort and insufficient consideration of the characteristically short switching strokes can be made in relation to the U.S. Pat. No. 3,958,093, granted May 18, 1976, in which roller contacts engage the outer surface of the actuation rod.

SUMMARY OF THE INVENTION

Therefore, with the foregoing in mind, it is a primary object of the present invention to provide a new and improved construction of a vacuum switch which does not exhibit the aforementioned drawbacks and shortcomings of the prior art constructions.

Another and more specific object of the present invention aims at providing a new and improved construction of a vacuum switch of the previously mentioned type in which the connecting conductor is particularly simple in relation to constructive effort and nevertheless guarantees a flawless contact between the actuation rod and the terminal, while presenting low mechanical resistance to the switch drive.

Yet a further significant object of the present invention aims at providing a new and improved construction of a vacuum switch of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the vacuum switch of the present invention is manifested by the features that the connecting conductor is constructed from an electrically conductive material as a rigid yoke extending substantially transverse to the contact actuation rod; the yoke having end regions; the yoke being divided at least at said end regions; the terminal being provided with a protrusion extending substantially toward the contact actuation rod; the contact actuation rod having mutually opposite first locations and the terminal having mutually opposite second locations; and the yoke frictionally engaging the contact actuation rod at the first locations and the terminal at the second locations under elastic action.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 1 schematically shows a longitudinal section through the components of a vacuum switch relevant to the present invention taken along the line I—I of FIG. 2;

FIG. 2 schematically shows a section taken along the line II—II of FIG. 1;

DETAILED DESCRIPTION OF THE PREFERRED EMBODIMENTS

Figure 3:
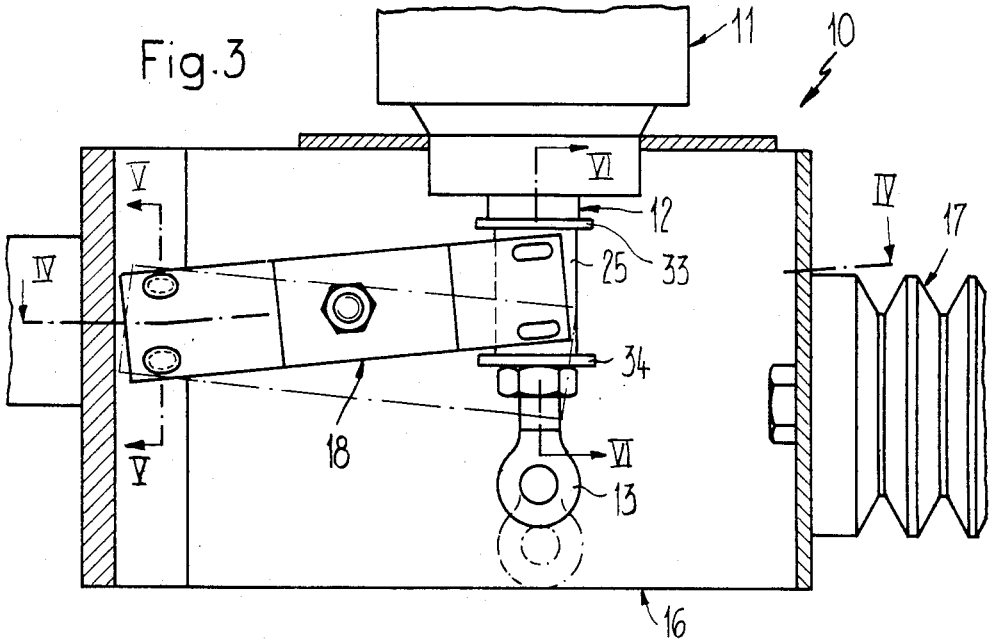
FIG. 3 schematically shows a further embodiment of the invention in a representation analogous to FIG. 1 and in a section taken along the line III—III of FIG. 4.
Figure 4:
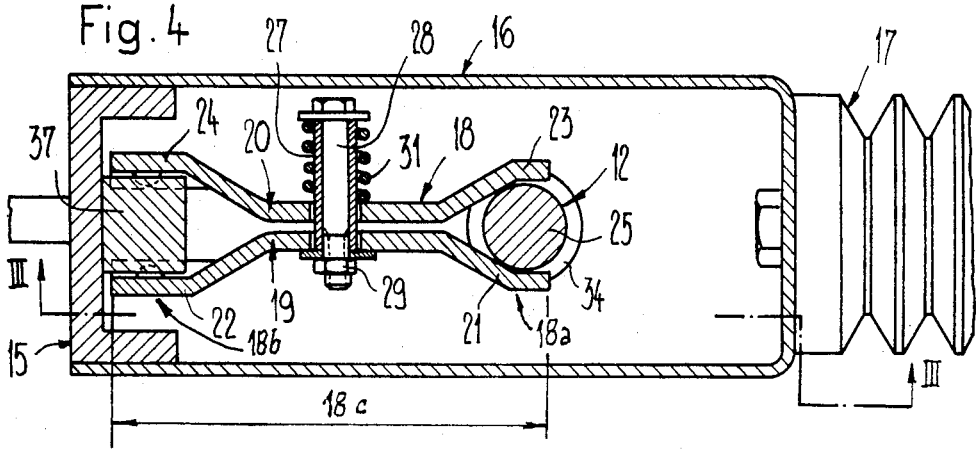
FIG. 4 schematically shows a section taken along the line IV—IV of FIG. 3.

Describing now the drawings, it is to be understood that to simplify the showing thereof only enough of the structure of the vacuum switch has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise components of a vacuum switch 10. This vacuum switch 10 comprises a vacuum vessel or chamber 11, in which both a stationary and a movable conventional contact member, both not particularly shown, are accommodated. The movable contact member is connected with an electrically conductive contact actuation rod 12 which is sealingly and translatably conducted out of the vacuum vessel or chamber 11. This contact actuation rod 12 is provided with an eye or clevis 13 at its end remote from the vacuum vessel or chamber 11. A not particularly shown conventional switch drive is connected to the eye 13 in order to move the contact actuation rod 12, and with it the movable contact member, from the closed switch position shown in solid line in FIG. 1 through the switch stroke 14 into the open switch position shown in dotted line in FIG. 1 and vice versa.

A stationary terminal 15 of the vacuum switch 10 associated with the contact actuation rod 12 here has the configuration of a massive or solid profile having the shape of the letter E in cross-section. A housing 16 surrounding the actuation rod 12 is connected with the not particularly shown conventional switch drive by an insulator member 17. Conventional buss bars, conventional cable leads or conventional isolating contacts, all not particularly shown, can be connected to the stationary terminal 15.

The electrical connection between the actuation rod 12 and the terminal 15 is effected by a yoke 18 defining an electrical connecting conductor and whose construction is described in the following. The yoke 18 comprises two longitudinally extending, exactly identically profiled but inversely arranged metallic strips 19 and 20 made, for instance, from copper or a copper alloy and which have a substantially rectangular cross-section. The mutually opposing end sections or regions 21, 23 and 22, 24 of the metallic strips 19 and 20, respectively, mutually diverge so that the ends of the yoke 18 appear forked. These end sections or regions 21, 23, 22 and 24 are formed such that they are in elastically frictional contact with a cylindrical section 25 of the actuation rod 12, on the one hand, and with a central rib or web 26, defining a protrusion, of the terminal 15, on the other hand, at mutually opposite locations in the manner of tweezers or pliers.

The metallic strips 19 and 20 extend substantially straight and substantially parallel to one another between the end sections or regions 21, 22 and 23, 24. The long sides of their rectangular cross-sections confront one another.

These metallic strips 19 and 20 are penetrated by a sleeve 27 in the center. A threaded member or bolt 28 with a screwed-on nut 29 passes through the sleeve 27. A compression spring 31 is supported between a washer 30 contacting the head of the bolt 28 and the metallic strip 20. The compression spring 31 biases the metallic strips 19 and 20 toward one another. A spacer 32 made of an insulative material may be provided between the metallic strips 19 and 20. The spacer 32 assures that the two metallic strips 19 and 20 cannot contact one another in their central sections or regions.

The compression spring 31 assures that the end sections or regions 21, 23 and 22, 24 of the metallic strips 19 and 20 contact the cylindrical section 25 and the protruding central rib or web 26 with a sufficient contact pressure. It must also be taken into consideration that when both metallic strips 19 and 20 conduct a heavy current, this contact pressure experiences a further increase, since the metallic strips 19 and 20 mutually attract one another due to the magnetic field arising as a consequence of the current.

It can be seen in FIG. 1 that two axial abutments or stop members 33 and 34 are present on both ends of the cylindrical section 25 of the contact actuation rod 12 between which the end sections or regions 21 and 23 engage with play. Two axial abutments or stop members 35 and 36 are also present on the rib or web 26 between which the end sections or regions 22 and 24 of the yoke 18 engage with play. The axial position of the end 18*a* of the yoke 18 in relation to the contact actuation rod 12 is therefore determined and the opposite end 18*b* of the yoke 18 appearing on the left in FIGS. 1 and 2 is also determined in its position in relation to the web or rib 26.

It can also be seen in FIG. 1 that the length 18*c* of the yoke 18 amounts to a multiple of the length of the switch stroke 14. This has the result that the contact lines between the end sections or regions 21 and 23 and the cylindrical section 25 as well as between the end sections or regions 22 and 24 and the rib or web 26 translate only slightly during a switch stroke, which gives rise to only low friction losses. However, the translation suffices to guarantee a self-cleaning effect along the contact lines.

The embodiment shown in FIGS. 3 through 6 differs from that of FIGS. 1 and 2 substantially in that the portion of the terminal 15 intended to engage the end sections or regions 22 and 24 of the metallic strips 19 and 20 does not have the form of a rib or web, but has the form of a protruding cylindrical stub 37, defining a protrusion, whose axis extends substantially perpendicular to the axis of the contact actuation rod 12.

Correspondingly, the end sections or regions 22 and 24 are constructed concave on their mutually confronting sides so that they substantially embrace the protruding cylindrical stub 37. The necessity of abutments or stop members on the side of the terminal 15 is thus obviated.

Figure 5:
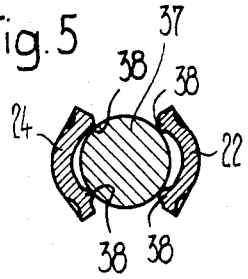
FIG. 5 schematically shows a section along the line V—V of FIG. 3.
Figure 6:
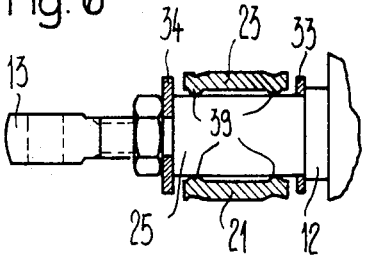
FIG. 6 schematically shows a section taken along the line VI—VI of FIG. 3 and rotated through 90°.

Furthermore, according to FIG. 5 the inner sides or faces of the end sections or regions 22 and 24 engaging the protruding cylindrical stub 37 as well as, according to FIG. 6, the inner sides or faces of the end sections or regions 21 and 23 engaging the cylindrical section 25 are provided with wart-like bosses 38 and 39, respectively, by punching or stamping. These bosses 38 and 39 serve to create well-defined contact points and furthermore assure that each metallic strip 19 and 20 of the yoke 18 always comprises two reliable contact points on each end independent of tolerances and dimensional inaccuracy. This is significant for conduction of the nominal or rated current. Furthermore, the surface specific contact pressure (analogous to that of roller contacts) is simultaneously increased, while the self-cleaning effect of the contact surfaces simultaneously remains guaranteed.

The yoke 18 could also be constructed integrally. If the yoke has been described in the illustrated and preferred embodiments as comprising two metallic strips 19 and 20, then only because the two metallic strips 19 and 20 can be fabricated very simply by punching, and preferably simultaneous punching or stamping, and because the assembly of the yoke 18 into the switch 11 is thereby facilitated.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A vacuum switch, comprising:

a vacuum chamber;

a contact actuation rod sealingly conducted out of said vacuum chamber and reciprocatable through a predetermined length of stroke for commutating electrical terminals of the vacuum switch; a portion of said contact actuation rod defining one terminal;

said portion of said contact actuation rod being electrically connected at said one terminal through at least one pivotally movable conductor to at least one stationary terminal;

said at least one connecting conductor being constructed from an electrically conductive material as a substantially rigid yoke extending substantially transverse to said contact.actuation rod;

said yoke having end regions;

said yoke being divided at least at said end regions;

said at least one stationary terminal being provided with at least one protrusion extending substantially toward said contact actuation rod and defining a pivot for said at least one connecting conductor when said contact actuation rod moves through said predetermined length of stroke;

said portion of said contact actuation rod having mutually opposite first locations;

said at least one protrusion having mutually opposite second locations; and said end regions of said yoke each respectively frictionally engaging one of said portion of said contact actuation rod at said first locations and said at least one stationary terminal at said second locations under elastic action to thereby provide an electrically conductive path between said contact actuation rod and said stationary terminal over the entire length of stroke of said contact actuation rod.

2. The vacuum switch as defined in claim 1, wherein:

said yoke is forked at said end regions.

3. The vacuum switch as defined in claim 1, wherein:

at least said contact actuation rod is provided with stop members;

one end region of said end regions of said yoke cooperating with said stop members permitting movement of said one end region upon movement of said actuation rod; and said stop members defining a relative axial position of said one end region in relation to said contact actuation rod.

4. The vacuum switch as defined in claim 1, wherein:

said yoke comprises two longitudinally extending metallic strips having end regions;

means for holding said two longitudinally extending metallic strips in mutually spaced relationship; and said end regions mutually diverging.

5. The vacuum switch as defined in claim 4, wherein:

said two longitudinally extending metallic strips each possess a substantially rectangular cross-section at least having mutually confronting long sides; and said two longitudinally extending metallic strips being held with said mutually confronting long sides in said mutually spaced relationship.

6. The vacuum switch as defined in claim 4, wherein:

said two longitudinally extending metallic strips have central regions; and said central regions extending substantially parallel to one another.

7. The vacuum switch as defined in claim 4, further including:

a spring having a spring action;

said two longitudinally extending metallic strips being subject to the spring action of said spring; and said spring action biasing said two longitudinally extending metallic strips toward one another.

8. The vacuum switch as defined in claim 1, wherein:

said end regions of said yoke have faces;

said end regions engaging said contact actuation rod and said at least one stationary terminal with said faces; and said faces being provided with substantially wart-like bosses.

9. The vacuum switch as defined in claim 1, wherein:

said yoke has a predetermined length; and said predetermined length comprising a multiple of said predetermined length of stroke of said contact actuation rod.

10. The vacuum switch as defined in claim 4, wherein:

said at least one protrusion of said at least one stationary terminal has the configuration of a substantially cylindrical stub;

said substantially cylindrical stub having an axis;

said axis extending substantially perpendicular to said contact actuation rod;

one of said end regions of said two longitudinally extending metallic strips cooperating with said at least one protrusion; and said one end region of said two longitudinally extending metallic strips possessing a configuration which partially surrounds said cylindrical stub.

11. The vacuum switch as defined in claim 4, wherein:

said at least one protrusion of said at least one stationary terminal comprises a rib formed upon said at least one stationary terminal and extending substantially parallel to said contact actuation rod;

said rib being provided with two stop members;

respective ends of one of said end regions of said yoke being associated with said two stop members; and said two stop members accommodating said respective ends between each other.

* * * * *